US011713876B1

(12) United States Patent
Jurasek

(10) Patent No.: US 11,713,876 B1
(45) Date of Patent: Aug. 1, 2023

(54) KAYAK PADDLE HAVING ILLUMINABLE BLADES

(71) Applicant: GLOW ROW LLC, Seadrift, TX (US)

(72) Inventor: Zachary Jurasek, Seadrift, TX (US)

(73) Assignee: GLOW ROW LLC, Seadrift, TX (US)

( * ) Notice: Subject to any disclaimer, the term of this patent is extended or adjusted under 35 U.S.C. 154(b) by 0 days.

(21) Appl. No.: 17/984,913

(22) Filed: Nov. 10, 2022

(51) Int. Cl.

| | |
|---|---|
| ***F21V 33/00*** | (2006.01) |
| ***F21V 23/00*** | (2015.01) |
| ***B63H 16/04*** | (2006.01) |
| ***F21V 31/00*** | (2006.01) |

(52) U.S. Cl.
CPC ..... *F21V 33/008* (2013.01); *B63H 16/04* (2013.01); *F21V 23/001* (2013.01); *F21V 31/005* (2013.01)

(58) Field of Classification Search
CPC .... F21V 33/008; F21V 23/001; F21V 31/005; B63H 16/04; B63H 1/30; B63H 45/02
USPC ..... 362/253; 440/101
See application file for complete search history.

(56) References Cited

U.S. PATENT DOCUMENTS

| | | | | |
|---|---|---|---|---|
| 7,303,452 | B1 * | 12/2007 | Ertz, III | B63B 45/04 440/101 |
| 2014/0111978 | A1 * | 4/2014 | Laurence | F21V 31/005 362/109 |
| 2015/0125296 | A1 * | 5/2015 | Swanson | B63H 16/04 416/5 |

* cited by examiner

*Primary Examiner* — Laura K Tso
(74) *Attorney, Agent, or Firm* — Jeffrey Streets; Madan Law PLLC

(57) ABSTRACT

A kayak paddle includes a tubular shaft having a first distal end and a second distal end, a first blade connected to the first distal end of the tubular shaft, and a second blade connected to the second distal end of the tubular shaft, wherein the first and second blades are made with a translucent material. The kayak paddle further includes a first light source secured within the tubular shaft and oriented to emit light from the first distal end into the first blade, a second light source secured within the tubular shaft and oriented to emit light from the second distal end into the second blade, and a battery electrically connected to the first and second light sources to supply electrical current that causes the first and second light sources to emit light.

20 Claims, 6 Drawing Sheets

KAYAK PADDLE HAVING ILLUMINABLE BLADES

BACKGROUND

The present disclosure relates to a kayak paddle.

BACKGROUND OF THE RELATED ART

A kayak is a small, narrow watercraft for one or two people. Kayaks are typically very narrow so that the one or two people in the kayak are able to use a paddle equally well on either side of the kayak. Accordingly, a kayak paddle is equipped with a blade on opposing ends of a shaft such that a person may paddle on alternating sides of the kayak using the opposing blades without having to change their grip on a shaft. The kayak paddle is not limited to use with a kayak but may also be used with a canoe or other narrow watercraft.

BRIEF SUMMARY

Some embodiments provide an apparatus known as a kayak paddle. The apparatus comprises a tubular shaft having a first distal end and a second distal end, a first blade connected to the first distal end of the tubular shaft, and a second blade connected to the second distal end of the tubular shaft, wherein the first and second blades are made with a translucent material. The apparatus further comprises a first light source secured within the tubular shaft and oriented to emit light from the first distal end into the first blade, a second light source secured within the tubular shaft and oriented to emit light from the second distal end into the second blade, and a battery electrically connected to the first and second light sources to supply electrical current that causes the first and second light sources to emit light.

DETAILED DESCRIPTION

Figure 1:
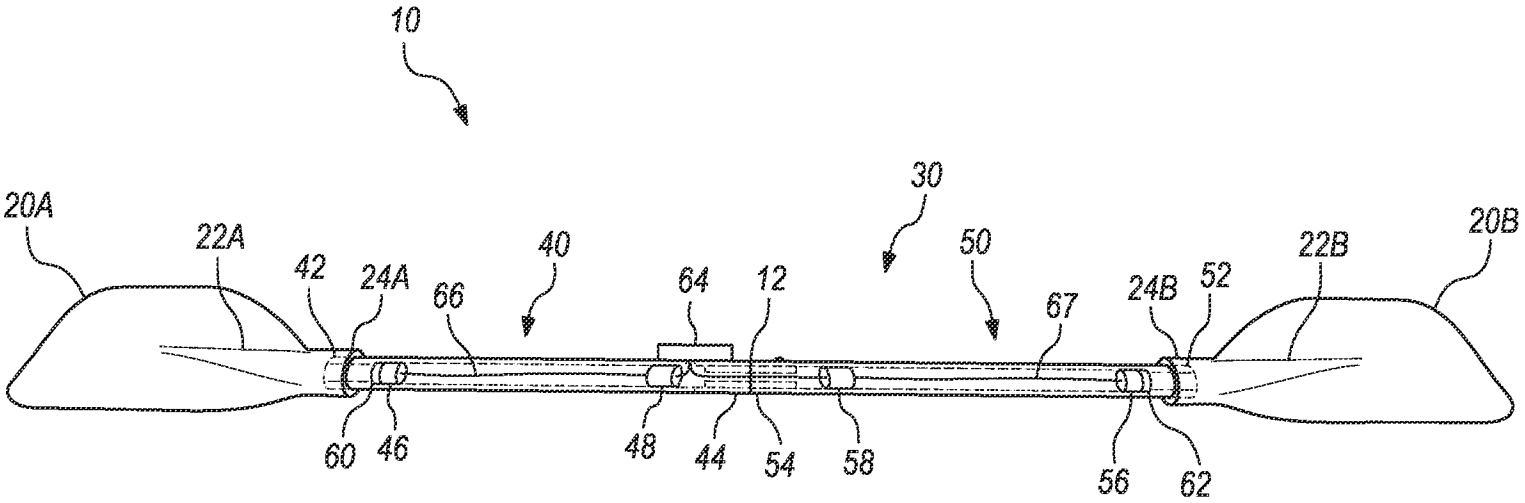
FIG. 1 is a diagram of a kayak paddle having two illuminable translucent blades.

Some embodiments provide an apparatus known as a paddle or kayak paddle. The apparatus comprises a tubular shaft having a first distal end and a second distal end, a first blade connected to the first distal end of the tubular shaft, and a second blade connected to the second distal end of the tubular shaft, wherein the first and second blades are made with a translucent material. The apparatus further comprises a first light source secured within the tubular shaft and oriented to emit light from the first distal end into the first blade, a second light source secured within the tubular shaft and oriented to emit light from the second distal end into the second blade, and a battery electrically connected to the first and second light sources to supply electrical current that causes the first and second light sources to emit light.

The tubular shaft or handle preferably has a circular or ovaloid cross-section and is preferably made with an aluminum alloy, a plastic material or other strong, lightweight and corrosion-resistant material. The tubular shaft should fit in a person's hand, perhaps having a diameter from about 22 millimeters and about 30 millimeters. Optionally, the tubular shaft may be formed with a first tubular section and a second tubular section that are selectively disconnectable. For example, a button clip may be used to selectively connect and disconnect one tubular section from the other simply by pressing a button. A pin of the button clip is biased to enter and span between aligned holes in two concentric tubular sections so that the sections are prevented from sliding axially. To connect the two sections, simply press the button pushing the two tubular sections together so that the button on the first section aligns with a hole in the second section. To disconnect the two sections, simply press the button while pulling the two tubular sections away from each other.

In some embodiments, the first and second light sources may be light-emitting diodes, incandescent light bulbs, and/or fluorescent light bulbs. Light-emitting diodes (LEDs) are preferred because they consume less electrical energy, require less space and are more durable under the vigorous and repeated movement of a kayak paddle. The first and second light sources may include one or more LEDs each, optionally secured to a common circuit board. For example, an LED board may have a diameter of 1 inch or less to be positionable perpendicular to an axis of the tubular shaft without touching the inner walls of the tubular shaft. The LEDs are directed to emit light into the blade and are preferably positioned about 1 to 3 inches from a distal end of the tubular shaft. The one or more LEDs may produce a single solid color of light or may produce any of a wide range of colors. In yet another option, the color of the LEDs may be user selectable. Furthermore, the LED at each end of the paddle may output from 40 to 100 lumens, such as about 50 lumens. In another option, the LED board may include multiple LEDs, such as 3 LEDs per board. In yet another option, the LED board may operate on a 12 Volt circuit. Furthermore, the board may include circuitry to operate in one or more mode, such as a normal operating mode where the lights are constantly on and/or an emergency mode where the lights blink a distress pattern indicating a need for help (i.e., an SOS signal). The board may be affixed to a distal face of a plug that is secured within the tubular shaft, perhaps being affixed with silicon or rubber to prevent corrosion. The wires that supply electrical current to each light source may be run through a hole in any one of the plugs, with the hole then sealed with silicon.

The kayak blades may have any standard or known shape that is suitable for a kayak blade but are preferably symmetrical to each other. However, the kayak blades are "illuminable", meaning that they are capable of being illuminated. For this purpose, the kayak blades are translucent, meaning that the blades permit the passage of light. Optionally, the blades may be a translucent with a colorant mixed in without making the blade opaque. For example, shining a white light through an object made with translucent purple material will make the object appear purple and may emit a purple light. In fact, the translucent blades may be transparent, meaning that the blades transmit light without appreciable scattering so that bodies lying beyond are seen clearly. A translucent blade may be made with polycarbonate or other polymeric materials.

In some embodiments, the kayak blades may have an open or hollow cavity inside the blade structure and the light sources emits light into the air cavity. The open cavity may extend down a central portion of the blade structure. Optionally, the open cavity may form a throat that opens up to accept a distal end of the tubular shaft. The open cavity, which may contain air or other gas, improves light distribution along the length of the blade. In addition, the open cavity may add buoyancy to the paddle when sealed off as further described below.

In some embodiments, the first blade forms a first throat that is connected to the first distal end of the tubular shaft, and wherein the second blade forms a second throat that is connected to the second distal end of the tubular shaft. Optionally, the first throat may be connected to the first distal end of the tubular shaft to form a water-tight seal therebetween, and wherein the second throat may be connected to the second distal end of the tubular shaft to form a water-tight seal therebetween. For example, the first throat may include a first open or hollow cavity and the second throat may include a second open or hollow cavity. The first hollow cavity may include a first conical cavity that extends into the first blade beyond the first distal end of the tubular shaft, and the second hollow cavity may include a second conical cavity that extends into the second blade beyond the second distal end of the tubular shaft. Furthermore, at least a portion of the first hollow cavity may fit over the first distal end of the tubular shaft so that the first blade may be secured to the tubular shaft with an adhesive. Similarly, at least a portion of the second hollow cavity may fit over the second distal end of the tubular shaft so that the second blade may be secured to the tubular shaft with an adhesive. A non-limiting example of a suitable adhesive is an epoxy resin. Preferably, the adhesive will form a water-tight seal between the blade and the tubular shaft.

In some embodiments, the apparatus may further comprise a first distal plug secured within the tubular shaft and forming a first water-tight cavity, wherein the first water-tight cavity includes the hollow cavity in the first blade and space within the tubular shaft that is distal of the first distal plug. Similarly, the apparatus may further comprise a second distal plug secured within the tubular shaft and forming a second water-tight cavity, wherein the second water-tight cavity includes the hollow cavity in the second blade and space within the tubular shaft that is distal of the second distal plug. The first distal plug is preferably inset from the first distal end of the tubular shaft and positioned proximal from the first light source, and the second distal plug is preferably inset from the second distal end of the tubular shaft and positioned proximal from the second light source. The first light source may be conveniently secured to a distal face of the first distal plug and the second light source may be conveniently secured to a distal face of the second distal plug. The distal plugs may be made with various materials, such as silicon and/or cork.

In some embodiments, the apparatus may further comprise a first proximal plug that is secured within the tubular shaft and is positioned a spaced distance in a proximal direction from the first distal plug to form a water-tight cavity extending between the first distal plug and the first proximal plug. The water-tight cavity provides additional buoyancy to the kayak paddle or at least one section of the kayak paddle. Similarly, the apparatus may further comprise a second proximal plug that is secured within the tubular shaft and is positioned a spaced distance in a proximal direction from the second distal plug to form a water-tight cavity extending between the second distal plug and the second proximal plug. The water-tight cavities provide additional buoyancy to the kayak paddle or each respective section of the kayak paddle.

Some embodiments may further comprise a hole through a wall of the tubular shaft, wherein the hole is located between the first proximal plug and the second proximal plug, and wherein the battery is secured to an exterior side of the tubular shaft adjacent the hole. An electrically conductive wire may then be extended from the battery, through the hole into the tubular shaft, and within the tubular shaft to the first and second light sources. Alternatively, the battery may be disposed within the tubular shaft, such as between the first and second proximal plugs, and accessible by separating first and second sections of the tubular shaft. In the latter implementation, the electrically conductive wire may extend from the battery to the first and second light sources. The first and second distal plugs and the first and second proximal plugs preferably each form a water-tight seal within the tubular shaft and around the electrically conductive wire.

In some embodiments, the tubular shaft may be formed with a first tubular section and a second tubular section that are selectively disconnectable. Although various connection mechanisms may be used to connect the first and second tubular sections, a button clip may be used as previously described. Optionally, a first distal plug may be secured within the first tubular section to form a first water-tight cavity, wherein the first water-tight cavity includes the hollow cavity in the first blade and space within the first tubular section that is distal of the first distal plug. The first light source may be secured to a distal face of the first distal plug, such that the first light source is positioned within the first water-tight cavity. Similarly, a second distal plug may be secured within the second tubular section to form a second water-tight cavity, wherein the second water-tight cavity includes the hollow cavity in the second blade and space within the second tubular section that is distal of the second distal plug. The second light source may be secured to a distal face of the second distal plug, such that the second light source is positioned within the second water-tight cavity.

In some embodiments having the tubular shaft form in first and second tubular sections, the apparatus may further comprise a first proximal plug secured within the first tubular section and positioned a spaced distance in a proximal direction from the first distal plug to form a water-tight cavity extending between the first proximal plug and the first distal plug. Similarly, the apparatus may further comprise a second proximal plug secured within the second tubular section and positioned a spaced distance in a proximal direction from the second distal plug to form a water-tight cavity extending between the second proximal plug and the second distal plug. The water-tight cavities between proximal and distal plugs provide additional buoyancy to the kayak paddle.

In some embodiments having the tubular shaft form in first and second tubular sections, a hole may be provided through a wall of the tubular shaft, where the hole is located between the first and second proximal plugs. Accordingly, the battery may be secured to an exterior side of the tubular shaft. An electrically conductive wire may extend from the battery, through the hole, and through the first and second tubular sections to the first and second light sources, where the first and second distal plugs and the first and second proximal plugs each form a water-tight seal within the tubular shaft and around the electrically conductive wire. Alternatively, the battery may be disposed within the tubular shaft, such as between the first and second proximal plugs, and accessible by separating first and second sections of the tubular shaft. In the latter implementation, the electrically conductive wire may extend within the tubular shaft from the battery to the first and second light sources. The first and second distal plugs and the first and second proximal plugs preferably each form a water-tight seal within the tubular shaft and around the electrically conductive wire.

In some embodiments, the electrically conductive wires may pass through or around the plug(s) as the wires extend from the battery to each light source. The plug or seal may be poured into position around the wire(s) or otherwise applied inside the tubular shaft in wet form and allowed to harden to its final form so that there are no gaps around the wires or within the tubular shaft.

One embodiment of the battery is a battery unit including a series of batteries in a stack, such as 6 lithium batteries, that are dipped in a waterproof rubber coating. The rubber-coated stack of batteries may be placed into a fabric pouch that is secured to the tubular shaft and secured in place using one or more strap with hook and loop fasteners. However, the battery may be contained in a compartment or housing that may be received within the tubular shaft and accessible by separating two sections of the tubular shaft. In one option, the battery or battery unit may provide a 12 Volt circuit to the light sources.

FIG. 1 is a diagram of kayak paddle 10 having a first illuminable translucent blade 20A and a second illuminable translucent blade 20B. The two illuminable translucent blades 20A, 20B are connected to opposing first and second distal ends of a tubular shaft 30. For example, the first blade 20A is connected to a first distal end 42 of the tubular shaft 30 and the second blade 20B is connected to a second distal end 52 of the tubular shaft 30. The two blades 20A, 20B may be, for example, identical or symmetrical.

The kayak paddle 10 is shown with a tubular shaft 30 that is made with a first tubular section 40 and a second tubular section 50, wherein the first tubular section 40 is selectively connectable to the second tubular section 50 at a central point 12. However, the central point 12 does not have to be a precise mid-point, but rather is some point that is generally near the center of the tubular shaft 30. As described herein, a component may be referred to as being "distal" or "proximal" with reference to the central point 12. For example, the first tubular section 40 has the (first) distal end 42 and a (first) proximal end 44, and the second tubular section 50 has the (second) distal end 52 and a (second) proximal end 54. Furthermore, the first tubular section 40 may contain a (first) distal plug 46 and a (first) proximal plug 48, and the second tubular section 50 may contain a (second) distal plug 56 and a (second) proximal plug 58.

The first blade 20A may have a hollow cavity 22A and a throat 24A that connects to the first distal end 42 of the first tubular section 40. For example, the throat 24A may be connected to the first distal end 42 using an adhesive that forms a water-tight seal therebetween. As a result, the hollow cavity 22A and a space inside the first tubular section 40 distal of the first distal plug 46 forms a water-tight cavity which may be filled with air. Similarly, the second blade 20B may have a hollow cavity 22B and a throat 24B that connects to the second distal end 52 of the second tubular section 50. For example, the throat 24B may be connected to the second distal end 52 using an adhesive that forms a water-tight seal therebetween. As a result, the hollow cavity 22B and a space inside the second tubular section 50 distal of the second distal plug 56 forms a water-tight cavity which may be filled with air. The hollow cavities 22A, 22B provide buoyancy to the kayak paddle 10 or their respective tubular section.

The first distal plug 46 and the first proximal plug 48 form a water-tight cavity therebetween that provides buoyancy to the kayak paddle 10 or the first tubular section 40. Similarly, the second distal plug 56 and the second proximal plug 58 form a water-tight cavity therebetween that provides buoyancy to the kayak paddle 10 or the second tubular section 50.

The kayak paddle 10 further includes a first light source 60, a second light source 62, and a battery 64 for providing electrical current to the first and second light sources 60, 62. Electrically conductive wires 66, 67 extend from the battery 64 to the first and second light sources 60, 62, respectively. Details regarding how the wires 66, 67 extend from the battery 64 to the first and second light sources 60, 62 through or around the plugs 46, 48, 46, 58 is provide elsewhere.

Figure 2A:
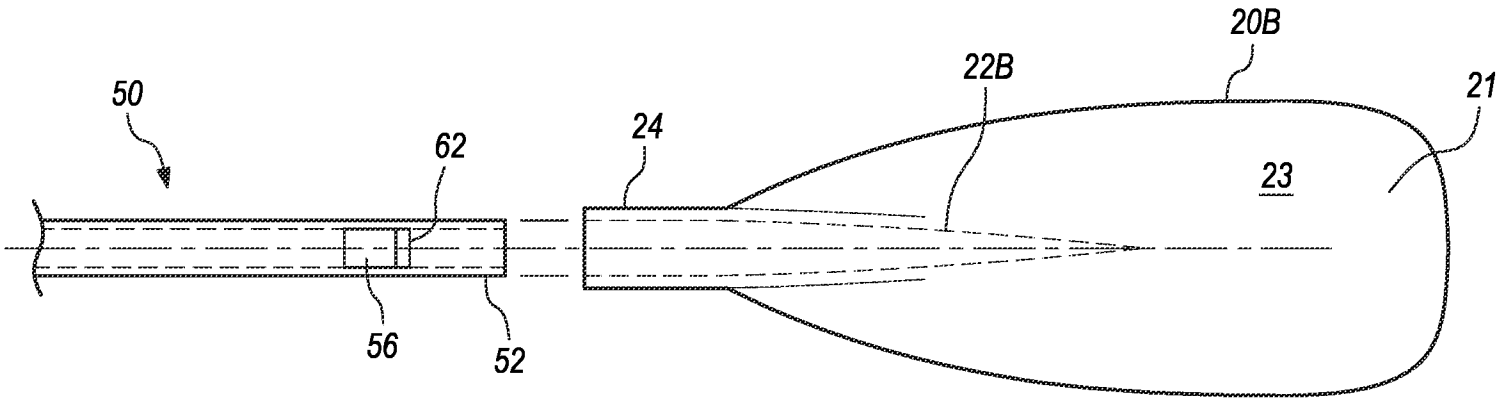
FIG. 2 is diagram of one translucent blade aligned to be secured to a distal end of a shaft of the kayak paddle.

FIG. 2A is diagram of the translucent blade 20B aligned to be secured to the distal end 52 of the tubular section 50 of the shaft of the kayak paddle 10 (see FIG. 1). The translucent blade 20B has a blade body 21 that is typically thin with a large surface area 23 suitable for pushing or pulling through water to propel a kayak or similar water-craft. The translucent blade 20B may be formed as a single piece (i.e., a monolithic structure), such as a polycarbonate. However, the thickness and contour of the blade body 21 may vary over the area of the blade 20B and may be thicker at a proximal end of the blade near the tubular section 50 (See FIG. 2B).

The translucent blade 20B has an interval cavity or void 22B. At least a portion of the cavity 22B may be aligned with the light source 62 so that light is directed through the cavity 22B and then into the translucent material of the blade. A proximal end of the cavity 22B may also form a throat 24, such as a tubular throat that has a snug fit around an outer surface of the second distal end 52 of the second tubular section 50. Accordingly, an adhesive such as an epoxy resin may be applied on an outer surface of the distal end 52 of the tubular section 50 and/or an inner surface of the cavity in the throat 24 of the translucent blade 20B, then the distal end 52 of the tubular section 50 may be inserted into the throat 24 of the translucent blade 20B. The distal end 52 is preferably inserted about a to about 3 inches into the throat 24 in order to form a strong connection. Optionally, the throat 24 may include a narrowed portion or a circumferential shoulder 26 than defines the extent to which the distal end 52 may be inserted.

As shown, the cavity 22B is a hollow internal cavity. Accordingly, if the adhesive connecting the distal end 52 to the throat 24 is water-tight, then a water-tight cavity is formed within the end of the kayak paddle. The water-tight cavity may include the space inside the tubular section 50 that is distal of the plug 56 and light source 62, as well as the space inside the cavity 22B that is distal of the distal end 52. The cavity 22B may have various shapes or internal contours within the blade 20B but is preferably tapered along the length of the cavity. Optionally, the cavity may be generally conical. The length of the cavity measured from the distal end 52 of the tubular section 50 may vary from about 6 inches to about 12 inches and is more preferably between about 8 and about 10 inches. The blade area is typically about 20 inches long and about 8 inches wide.

Figure 2B:
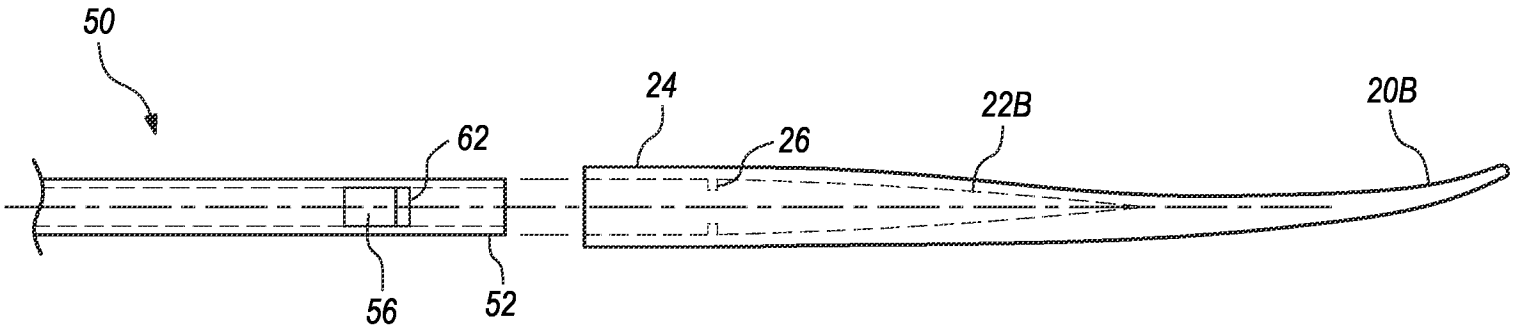

It should be understood that the other translucent blade 20A may be secured to the distal end 42 of the tubular section 40 of the shaft of the kayak paddle 10 (See FIG. 1) in the same or substantially the same manner as shown in FIGS. 2A-B.

Figure 3A:
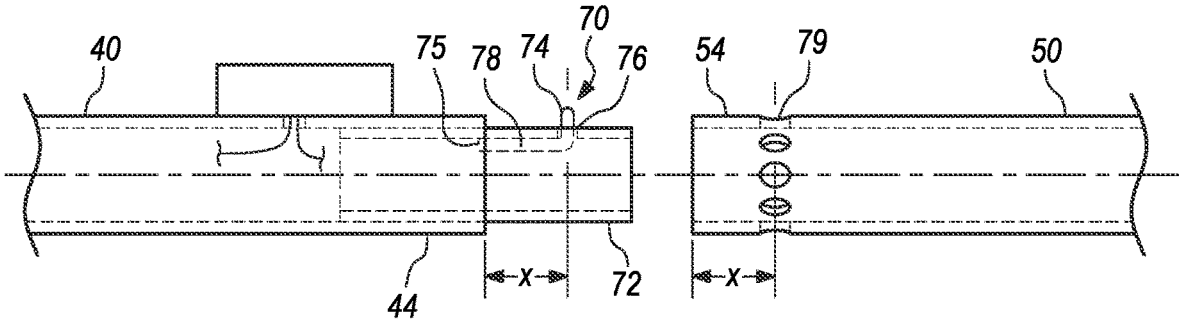
FIGS. 3A-C are diagrams illustrating two tubular sections of the shaft being connected and secured with a button clip.
Figure 3B:
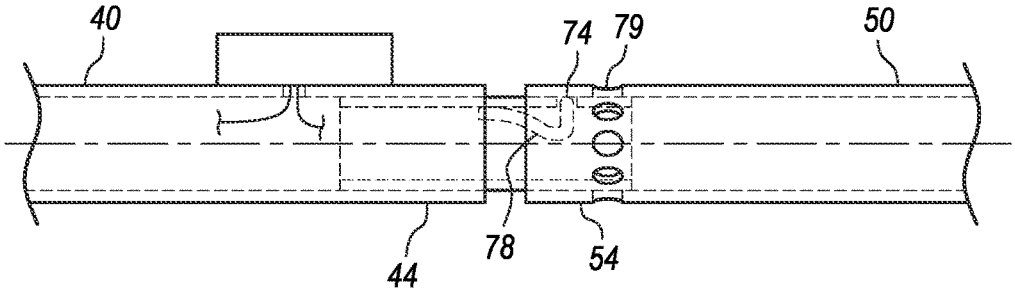
Figure 3C:
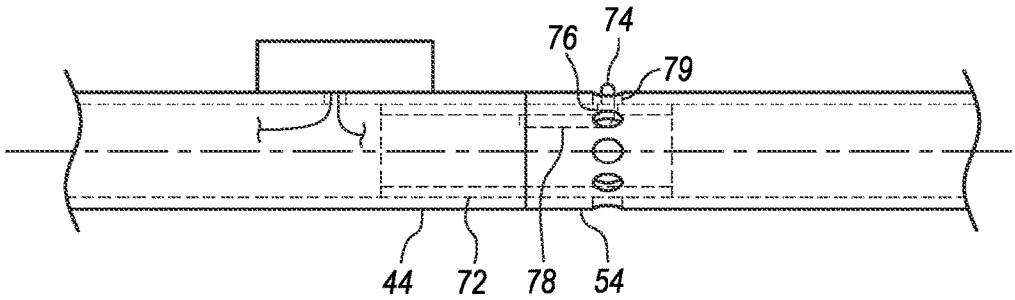

FIGS. 3A-C are diagrams illustrating the first and second tubular sections 40, 50 of the tubular shaft 30 being connected and secured with a button clip 70. In this example, the proximal end 44 of the first tubular section 40 has an inner concentric sleeve 72 that is secured within the first tubular section 40, such as by welding or adhering, so that the concentric sleeve 72 extends from the proximal end 44. A button 74 is aligned with a button hole 76 through the wall of the concentric sleeve 72 and a flexible tab 78 extending laterally from the button 74 has an end 75 that is secured to the inner surface of the concentric sleeve 72.

The second tubular section 50 has one or more holes 79 that are located a distance ("X") from the proximal end 54 of the second tubular section 50, where the distance ("X") is equal to the distance of the button 74 from the proximal end 44 of the first tubular section 40. Optionally, the second tubular section 50 may include multiple holes 79 angularly spaced about the section 50 as shown. The selection of one of the holes 79 may be used to control an amount of feathering between the first and second blades 20A, 20B.

FIG. 3B illustrates the first and second tubular sections 40, 50 of the tubular shaft 30 in the process of being connected. The button 74 of the button clip 70 has been depressed inwardly to allow the concentric sleeve 72 to be inserted within the second tubular section 50. Accordingly, the flexible tab 78 has been flexed and now biases the button 74 against the inside surface of the second tubular section 50 until further insertion of the concentric sleeve 72 places the button 74 in alignment with one of the holes 79 in the second tubular section 50.

FIG. 3C illustrates the button 79 extending through both the button hole 76 in the concentric sleeve 72 and also the hole 79 in the second tubular section 50. The first and second tubular sections 40, 50 are now secured together until the button 79 is again depressed inwardly, such as using a person's finger, to release the button clip 70.

Figure 4A:
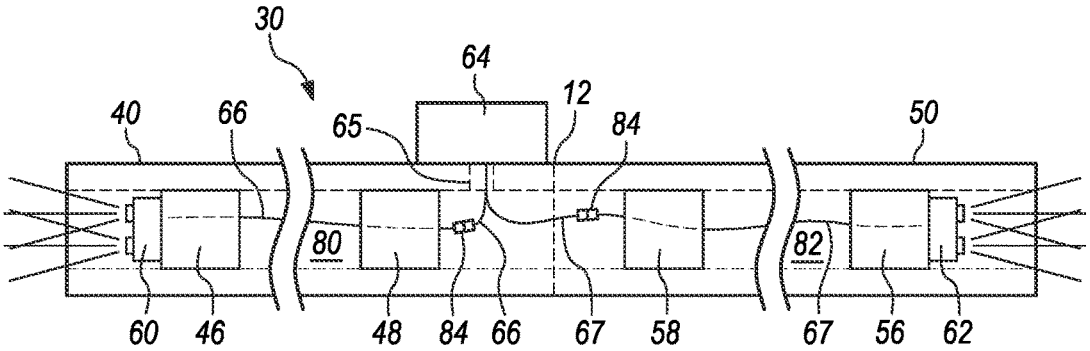
FIGS. 4A-B are electrical plan views illustrating electrical wire extending from a battery to the first and second light sources.
Figure 4B:
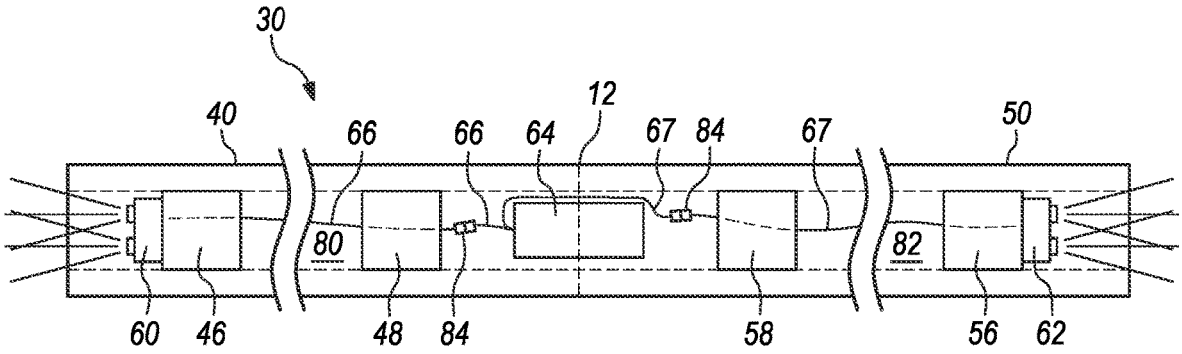

FIGS. 4A-B are electrical plan views illustrating electrical wire extending from a battery to the first and second light sources. FIG. 4A discloses an embodiment with the battery 64 secured to the outside of the tubular shaft 30, whereas FIG. 4B discloses an embodiment with the battery 64 secured within the tubular shaft 30.

In FIG. 4A, a hole 65 is formed through the tubular shaft 30 in a location between the first proximal plug 48 and the second proximal plug 58, and wherein the battery 64 is secured to an exterior side of the tubular shaft 30 adjacent the hole 65. An electrically conductive wire 66 may be extended from the battery 64 to the first light source 60 by passing the wire 66 through the hole 65 into the tubular shaft 30, and within the tubular shaft 30 to the first light source 60. The wire 66 may be passed through a central portion of the plugs 46, 48 or along an interior wall of the tubular shaft 30, but the plugs 46, 48 preferably form a water-tight seal with the wall and the wire. Similarly, an electrically conductive wire 67 may branch to the second light source 62 or may be extended from the battery 64 to the second light source 62 by passing the wire 67 through the hole 65 into the tubular shaft 30, and within the tubular shaft 30 to the second light source 62. The wire 67 may be passed through a central portion of the plugs 56, 58 or along an interior wall of the tubular shaft 30, but the plugs 56, 58 preferably form a water-tight seal with the wall and the wire. A first water-tight cavity 80 may be formed between the plugs 46, 48 and a second water-tight cavity 82 may be formed between the plugs 56, 58. Optionally, the wires 66, 67 may include connectors 84 to facilitate quick connection and disconnection to the battery 64, such as when the first and second tubular sections 40, 50 are to be disconnected or the battery needs to be replaced.

In FIG. 4B, the battery is disposed within the tubular shaft 30, such as between the first and second proximal plugs 48, 58. Accordingly, the hole 65 of FIG. 4A is not necessary or desired, and access to the battery 64 requires separating the first and second sections 40, 50 of the tubular shaft. In the latter implementation, the electrically conductive wire 66, 67 may extend from the battery 64 to the first and second light sources 60, 62 in substantially the same manner as described in reference to FIG. 4A. The first and second distal plugs 46, 56 and the first and second proximal plugs 48, 58 preferably each form a water-tight seal within the tubular shaft and around the electrically conductive wires 66, 67.

FIG. SA is a diagram of a battery unit 64 having multiple individual batteries 90 (6 batteries shown) and one set of branched wires 66, 67 that each terminate in a connector 84 for providing power to a respective one of the first and second light sources 60, 62 (not shown). The non-limiting example of the battery unit 64 includes a series of disk batteries 90 in a stack 94, such as 6 lithium batteries, that are dipped in a waterproof rubber coating 92. The rubber-coated stack of batteries may be placed into a fabric pouch that is secured to the tubular shaft and secured in place using one or more strap with hook and loop fasteners. However, the battery 64 may be contained in a compartment or housing that may be received within the tubular shaft and accessible by separating two sections of the tubular shaft. In one option, the battery or battery unit may provide a 12 Volt circuit to the light sources.

The individual batteries 90 may be secured in the stack 94 with the anode of one battery in contact with the cathode of the next battery by straps 96 or other mechanical structure. Conductive plates 95, 97 may be secured at each end of the stack 94 to facilitate an electrical connection to the wires 66, 67. For example, the connections between the wires and the plates may be soldered or clipped. Once the stack 94 has been formed and the wires 66, 67 have been connected to the stack 94, the assembly may be coated in rubber 92, perhaps by applying liquid rubber (or other nonconductive material) with a brush or dipping the assembly into a container of the liquid rubber (or other nonconductive material).

Figure 5A:
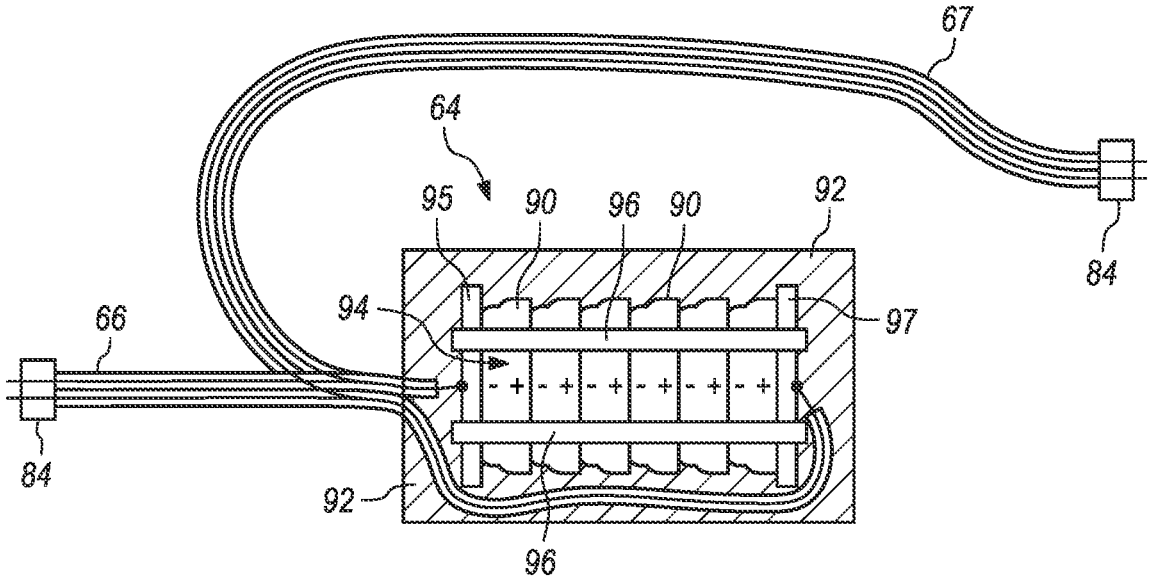
FIG. 5A is a diagram of a battery unit having multiple individual batteries and one set of wires that split to terminate in a connector for providing power to each of the light sources.
Figure 5B:
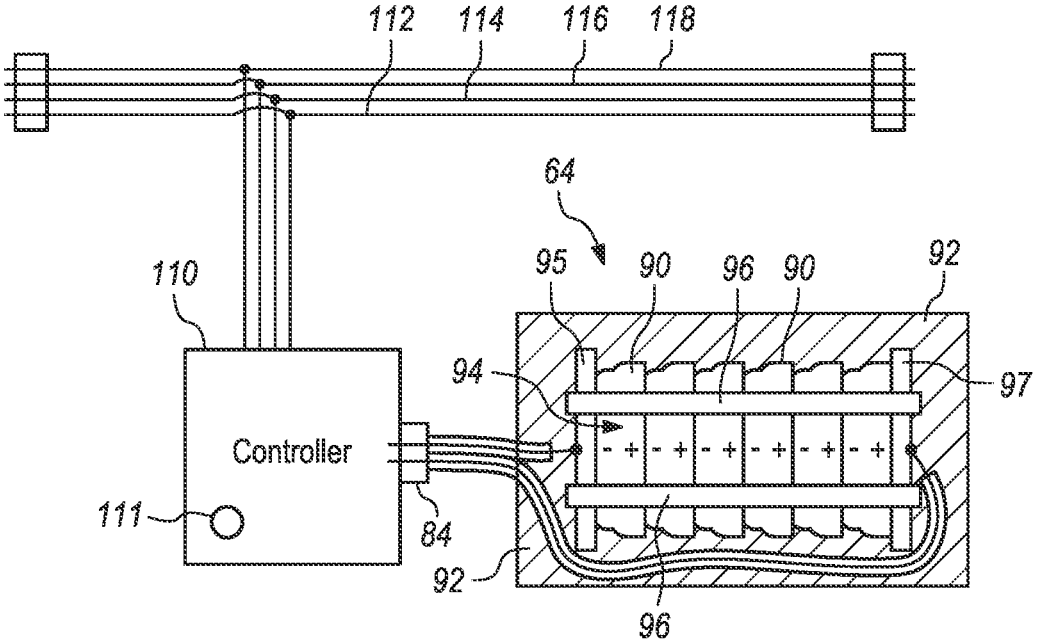
FIG. 5B is a diagram of the battery unit providing power to a controller that provides control signals to each of the light sources, such as to provide a color change signal or an on/off signal.

FIG. 5B is a diagram of the battery unit 64 providing power through a connector 84 to a controller 110 that provides control signals to each of the light sources 60, 62 (not shown), such as to provide a color change signal or an on/off signal. For example, the controller 110 may provide a control signal on a separate wire 112, 114, 116, 118 cause the lights sources to emit light of a different color. In one option, a first wire 112 may cause the light sources to emit red light, a second wire 114 may cause the light sources to emit green light, a third wire 116 may cause the light sources to emit blue light, and a fourth wire 118 may cause the light sources to emit purple light. Optionally, the controller 110 may cycle through the different colors or may be set to a single color selected by pressing a button 111.

Figure 6A:
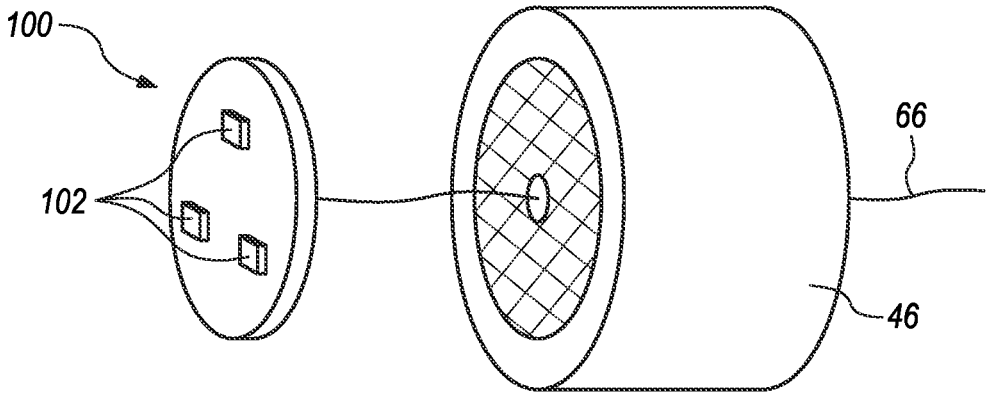
FIGS. 6A and 6B are diagrams illustrating a circuit board with light emitting diodes (LEDs) being secured to a plug with an electrically conductive wire extending through the plug.
Figure 6B:
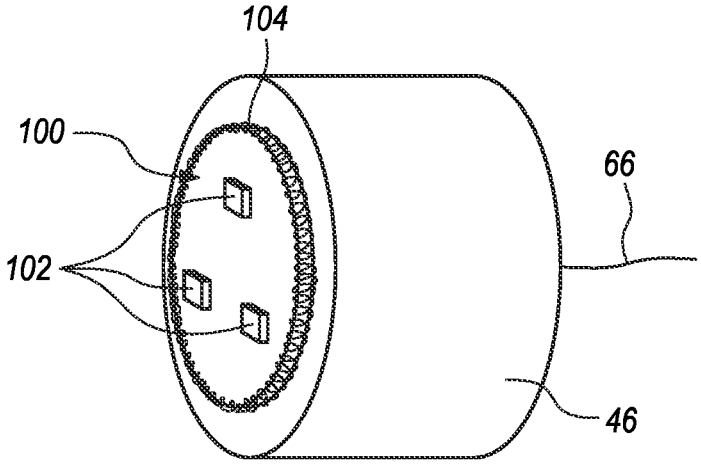

FIGS. 6A and 6B are diagrams illustrating a circuit board 100 with light emitting diodes (LEDs) 102 being secured to a plug 46 with an electrically conductive wire 66 extending through the plug. In reference to FIG. 6A, the wire 66 that supplies electrical current to the circuit board 100 (light source 60) may be run through a hole in the plug 46 or any of the plugs. The hole may then be sealed with silicon or other water-tight material. Preferably, the LED circuit board 100 may have a diameter of about 1 inch or less, and preferably less than the diameter of the plug 46. Accordingly, when the plug is inserted into the tubular shaft 30, the LED circuit board 100 is positioned perpendicular to an axis of the tubular shaft 30 without touching the inner walls of the tubular shaft 30 (see FIGS. 4A-B). The LEDs 102 are directed to emit light into the blade and are preferably positioned about 1 to 3 inches from a distal end of the tubular shaft. The circuit board 100 itself may be affixed to the plug with silicon or rubber 104, without covering the LEDs 102, to prevent displacement of the circuit board 100 and to prevent corrosion of components on the circuit board 100. Optionally, the plug 46 to which the light source is secured may be made with cork.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. An apparatus, comprising:

a tubular shaft having a first distal end and a second distal end, wherein the tubular shaft is formed with a first tubular section and a second tubular section that are selectively disconnectable;

a first distal plug secured within the first tubular section;

a first proximal plug secured within the first tubular section and positioned a spaced distance in a proximal direction from the first distal plug to form a water-tight cavity extending between the first proximal plug and the first distal plug;

a second distal plug secured within the second tubular section;

a second proximal plug secured within the second tubular section and positioned a spaced distance in a proximal direction from the second distal plug to form a water-tight cavity extending between the second proximal plug and the second distal plug;

a first blade connected to the first distal end of the tubular shaft, wherein the first blade is made with a translucent material;

a second blade connected to the second distal end of the tubular shaft, wherein the second blade is made with a translucent material;

a first light source secured within the tubular shaft and oriented to emit light from the first distal end into the first blade;

a second light source secured within the tubular shaft and oriented to emit light from the second distal end into the second blade; and a battery electrically connected to the first and second light sources to supply electrical current that causes the first and second light sources to emit light.

2. The apparatus of claim 1, wherein the first and second light sources are independently selected from the group consisting of light-emitting diodes, incandescent light bulbs, and fluorescent light bulbs.

3. The apparatus of claim 1, wherein the translucent material is a polycarbonate.

4. The apparatus of claim 1, wherein the tubular shaft is made with an aluminum alloy tube.

5. The apparatus of claim 1, wherein the tubular shaft is made with a plastic material.

6. The apparatus of claim 1, wherein the first blade forms a first throat that is connected to the first distal end of the tubular shaft, and wherein the second blade forms a second throat that is connected to the second distal end of the tubular shaft.

7. The apparatus of claim 6, wherein the first throat is connected to the first distal end of the tubular shaft to form a water-tight seal therebetween, and wherein the second throat is connected to the second distal end of the tubular shaft to form a water-tight seal therebetween.

8. The apparatus of claim 7, wherein the first throat includes a first hollow cavity and the second throat includes a second hollow cavity.

9. The apparatus of claim 8, wherein the first hollow cavity includes a first conical cavity that extends into the first blade beyond the first distal end of the tubular shaft, and wherein the second hollow cavity includes a second conical cavity that extends into the second blade beyond the second distal end of the tubular shaft.

10. The apparatus of claim 8, wherein at least a portion of the first hollow cavity fits over the first distal end of the tubular shaft and is secured to the tubular shaft with an adhesive, and wherein at least a portion of the second hollow cavity fits over the second distal end of the tubular shaft and is secured to the tubular shaft with an adhesive.

11. The apparatus of claim 10, wherein the adhesive is an epoxy resin.

12. The apparatus of claim 8, wherein the first distal plug forms a first water-tight cavity that includes the hollow cavity in the first blade and space within the tubular shaft that is distal of the first distal plug, and wherein the second distal plug forms a second water-tight cavity that includes the hollow cavity in the second blade and space within the tubular shaft that is distal of the second distal plug.

13. The apparatus of claim 12, wherein the first distal plug is inset from the first distal end of the tubular shaft and positioned proximal from the first light source, and wherein the second distal plug is inset from the second distal end of the tubular shaft and positioned proximal from the second light source.

14. The apparatus of claim 13, wherein the first light source is secured to a distal face of the first distal plug and the second light source is secured to a distal face of the second distal plug.

15. An apparatus comprising:

a tubular shaft having a first distal end and a second distal end;

a first blade including a first throat connected to the first distal end of the tubular shaft and forming a water-tight seal therebetween, wherein the first blade is made with a translucent material, and wherein the first throat includes a first hollow cavity;

a second blade including a second throat connected to the second distal end of the tubular shaft and forming a water-tight seal therebetween, wherein the second blade is made with a translucent material, and wherein the second throat includes a second hollow cavity;

a first light source secured within the tubular shaft and oriented to emit light from the first distal end into the first blade;

a second light source secured within the tubular shaft and oriented to emit light from the second distal end into the second blade;

a battery electrically connected to the first and second light sources to supply electrical current that causes the first and second light sources to emit light;

a first distal plug secured within the tubular shaft and forming a first water-tight cavity, wherein the first water-tight cavity includes the hollow cavity in the first blade and space within the tubular shaft that is distal of the first distal plug, and wherein the first distal plug is inset from the first distal end of the tubular shaft and the first light source is secured to a distal face of the first distal plug;

a second distal plug secured within the tubular shaft and forming a second water-tight cavity, wherein the second water-tight cavity includes the hollow cavity in the second blade and space within the tubular shaft that is distal of the second distal plug, and wherein the second distal plug is inset from the second distal end of the tubular shaft and the second light source is secured to a distal face of the second distal plug;

a first proximal plug secured within the tubular shaft and positioned a spaced distance in a proximal direction from the first distal plug to form a water-tight cavity extending between the first distal plug and the first proximal plug; and a second proximal plug secured within the tubular shaft and positioned a spaced distance in a proximal direction from the second distal plug to form a water-tight cavity extending between the second distal plug and the second proximal plug.

16. The apparatus of claim 15, further comprising:

a hole through a wall of the tubular shaft between the first proximal plug and the second proximal plug, wherein the battery is secured to an exterior side of the tubular shaft adjacent the hole; and electrically conductive wire extending from the battery, through the hole into the tubular shaft, and within the tubular shaft to the first and second light sources.

17. The apparatus of claim 16, wherein the first and second distal plugs and the first and second proximal plugs each form a water-tight seal within the tubular shaft and around the electrically conductive wire.

18. The apparatus of claim 1, wherein the tubular shaft is formed with a first tubular section and a second tubular section that are selectively disconnectable, further comprising:

a first distal plug secured within the first tubular section and forming a first water-tight cavity, wherein the first water-tight cavity includes the hollow cavity in the first blade and space within the first tubular section that is distal of the first distal plug, wherein the first light source is secured to a distal face of the first distal plug; and a second distal plug secured within the second tubular section and forming a second water-tight cavity, wherein the second water-tight cavity includes the hollow cavity in the second blade and space within the second tubular section that is distal of the second distal.

19. An apparatus, comprising:

a tubular shaft having a first distal end and a second distal end, wherein the tubular shaft is formed with a first tubular section and a second tubular section that are selectively disconnectable;

a first blade connected to the first distal end of the tubular shaft, wherein the first blade is made with a translucent material;

a second blade connected to the second distal end of the tubular shaft, wherein the second blade is made with a translucent material;

a first light source secured within the tubular shaft and oriented to emit light from the first distal end into the first blade;

a second light source secured within the tubular shaft and oriented to emit light from the second distal end into the second blade;

a battery electrically connected to the first and second light sources to supply electrical current that causes the first and second light sources to emit light;

a first distal plug secured within the first tubular section and forming a first water-tight cavity, wherein the first water-tight cavity includes the hollow cavity in the first blade and space within the first tubular section that is distal of the first distal plug, wherein the first light source is secured to a distal face of the first distal plug;

a second distal plug secured within the second tubular section and forming a second water-tight cavity, wherein the second water-tight cavity includes the hollow cavity in the second blade and space within the second tubular section that is distal of the second distal plug, wherein the second light source is secured to a distal face of the second distal plug;

a first proximal plug secured within the first tubular section and positioned a spaced distance in a proximal direction from the first distal plug to form a water-tight cavity extending between the first proximal plug and the first distal plug; and a second proximal plug secured within the second tubular section and positioned a spaced distance in a proximal direction from the second distal plug to form a water-tight cavity extending between the second proximal plug and the second distal plug.

20. The apparatus of claim 19, further comprising:

a hole through a wall of the tubular shaft between the first and second proximal plugs, wherein the battery is secured to an exterior side of the tubular shaft; and electrically conductive wire extending from the battery, through the hole, and through the first and second tubular sections to the first and second light sources, where the first and second distal plugs and the first and second proximal plugs each form a water-tight seal within the tubular shaft and around the electrically conductive wire.

* * * * *